US008941553B1

(12) United States Patent
Pochop, Jr.

(10) Patent No.: US 8,941,553 B1
(45) Date of Patent: Jan. 27, 2015

(54) METHODS AND APPARATUS FOR ANTENNA SYSTEM WITH SELECTIVELY ACTIVATABLE SEGMENTS

(71) Applicant: Juniper Networks, Inc., Sunnyvale, CA (US)

(72) Inventor: Jeffrey L. Pochop, Jr., Los Gatos, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 190 days.

(21) Appl. No.: 13/630,397

(22) Filed: Sep. 28, 2012

(51) Int. Cl.
*H01Q 3/24* (2006.01)

(52) U.S. Cl.
USPC ..... 343/876; 343/853

(58) Field of Classification Search
USPC ..... 343/725, 853, 876
See application file for complete search history.

(56) References Cited

U.S. PATENT DOCUMENTS

| | | | | |
|---|---|---|---|---|
| 6,456,257 | B1 * | 9/2002 | Zamat | 343/876 |
| 6,624,791 | B1 * | 9/2003 | Rausch | 343/766 |
| 8,081,123 | B2 * | 12/2011 | Yang | 343/702 |
| 8,279,132 | B2 * | 10/2012 | Jung et al. | 343/853 |
| 2013/0257680 | A1 * | 10/2013 | Nix et al. | 343/876 |

* cited by examiner

*Primary Examiner* — Tho G Phan
(74) *Attorney, Agent, or Firm* — Cooley LLP

(57) ABSTRACT

In some embodiments, an apparatus comprises of a ground plane control module included in an antenna system having a set of antenna segments that includes a first antenna segment, a second antenna segment, and a third antenna segment, with each antenna segment associated with a separate ground plane. The ground plane control module is configured to selectively activate the ground plane of the first antenna segment and the second antenna segment such that receive signals and transmit signals are communicated with a first and second user, respectively, when the ground planes of the first and second antenna segments, respectively, are in an activate mode. The ground plane control module is configured to selectively activate the ground plane of the third antenna segment such that the third antenna segment cannot communicate receive signals and transmit signals when the ground plane of the third antenna segment is in a deactivate mode.

8 Claims, 9 Drawing Sheets

100

METHODS AND APPARATUS FOR ANTENNA SYSTEM WITH SELECTIVELY ACTIVATABLE SEGMENTS

BACKGROUND

Some embodiments described herein relate generally to methods and apparatus for configuring directional or beam-steering antenna systems.

Known antenna systems typically operate in an omni-directional mode where each known antenna system receives and/or transmits signals in all directions. Known antenna systems operating in an omni-directional mode typically have weak performances because the transmission and/or reception capability of the antenna systems are spread over all directions, where many of the directions are not associated with any user communication devices in communication with the antenna systems. Hence, a significant portion of the transmission and/or reception capability of omni-directional antenna systems is lost or unused. The lost capability of omni-directional antenna systems can lead to significant reduction in the quality of the transmitted and/or received signals and also a reduction in the maximum range of user communication devices that communicate with the antenna systems.

Known methods of implementing directional or beam-steering antenna systems can increase the strength of transmit signals to a user communication device via the selective directional transmission of signals to the specific user communication device. Such known methods, however, cannot increase the strength of reception signals from user communication devices because reception signals are non-deterministic, i.e., the antenna systems cannot predict when a user communication device will send a signal and thus the antenna systems cannot direct their reception towards a user communication device before the user communication device sends a signal. Hence, such known methods configure the antenna systems in a directional mode when transmitting signals and then configure the antenna systems to an omni-directional mode when receiving signals. This limits the quality of the reception signals of the antenna systems and the effective range for communication to a user communication device as the beam-steering feature is disabled during reception of signals.

Accordingly, a need exists for methods and apparatus for configuring antenna systems to operate in a directional or beam-steering mode for both transmission and reception of signals to a user communication device(s).

SUMMARY

In some embodiments, an apparatus comprises of a ground plane control module included in an antenna system having a set of antenna segments that includes a first antenna segment, a second antenna segment, and a third antenna segment, with each antenna segment associated with a separate ground plane. The ground plane control module is configured to selectively activate the ground plane of the first antenna segment and the second antenna segment such that receive signals and transmit signals are communicated with a first and second user, respectively, when the ground planes of the first and second antenna segments, respectively, are in an activate mode. The ground plane control module is configured to selectively activate the ground plane of the third antenna segment such that the third antenna segment cannot communicate receive signals and transmit signals when the ground plane of the third antenna segment is in a deactivate mode.

DETAILED DESCRIPTION

Figure 1A:
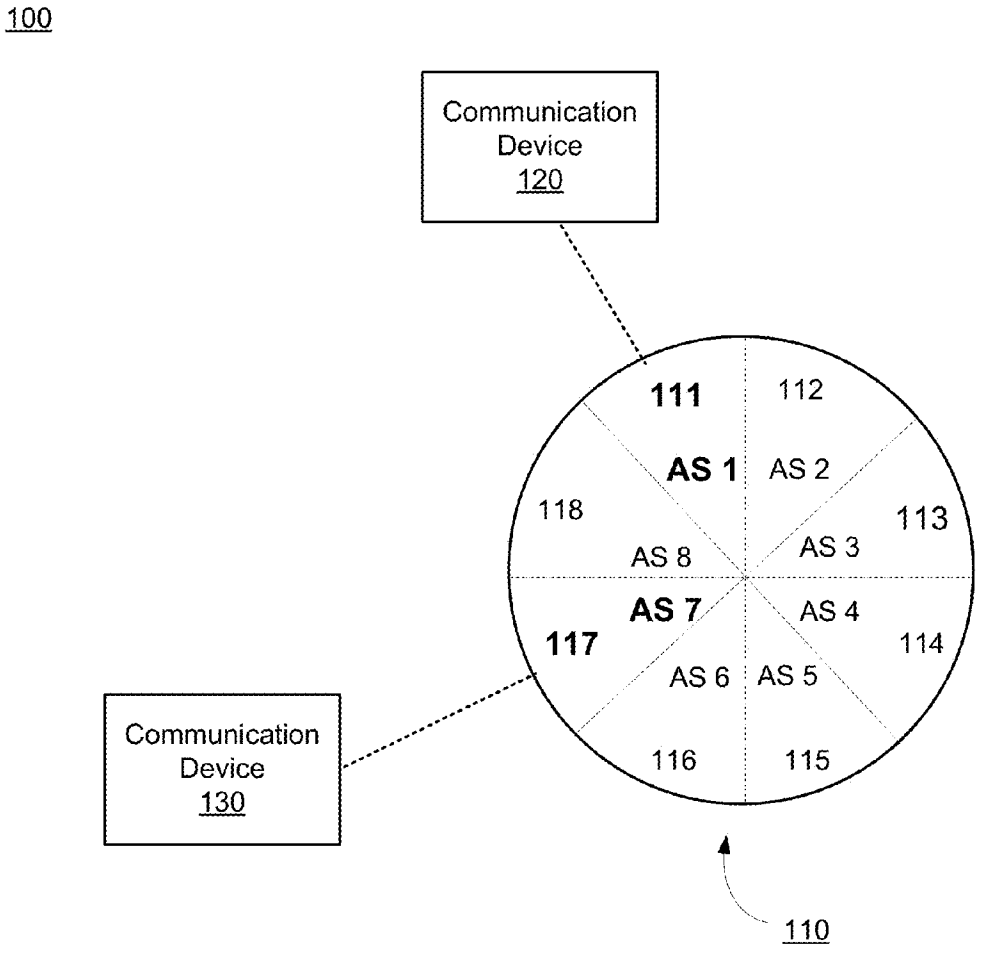
FIGS. 1A-C are schematic illustrations of an example of a multi-segmented antenna system with multiple antenna segments in the activate mode connected to multiple users implemented in a wireless local area network (WLAN), according to different configurations.

In some embodiments, an apparatus comprises of a ground plane control module included in an antenna system having a set of antenna segments disposed about a perimeter. The apparatus includes a first antenna segment having a ground plane, a second antenna segment non-adjacent to the first antenna segment that also has a ground plane, and a third antenna segment having a ground plane. The ground plane control module is configured to selectively activate the ground plane of the first antenna segment such that receive signals and transmit signals are communicated with a first user when the ground plane of the antenna segment is in an activate mode. The ground plane control module is configured to selectively activate the ground plane of the second antenna segment such that receive signals and transmit signals are communicated with a second user when the ground plane of the second antenna segment is in an activate mode. The ground plane control module is also configured to selectively activate the ground plane of the third antenna segment such that the third antenna segment cannot communicate receive signals and transmit signals when the ground plane of the third antenna segment is in a deactivate mode.

In some embodiments, a method comprises of enabling a first antenna segment from a set of antenna segments based on a first user from a set of users being in communication with the first antenna segment. The method also comprises of enabling a second antenna segment from a set of antenna segments based on a second user from the set of users being in communication with the second antenna segment, where the second antenna segment is non-adjacent to the first antenna segment. The method further comprises of disabling a third antenna segment from the set of antenna segments based on no users from the set of users being in communication with the third antenna segment.

In some embodiments, an apparatus comprises of an antenna segment control module configured to selectively attenuate signals to a set of antenna segments, and selectively strengthen signals to the set of antenna segments. The set of antenna segments includes a first antenna segment in communication with a first user from a set of users, a second antenna segment in communication with a second user from the set of users, and a third antenna segment not in communication with the set of users. The antenna segment control module is configured to divert power from the third antenna segment to the first antenna segment and to the second antenna segment such that a signal to the third antenna segment is attenuated and the third antenna segment is unable to send and receive signals from the set of users. Additionally, a signal to the first antenna segment is strengthened and a signal to the second antenna segment is also strengthened.

As used in this specification, the singular forms "a," "an" and "the" include plural referents unless the context clearly dictates otherwise. Thus, for example, the term "a communication device" is intended to mean a single communication device or a combination of communication devices.

Figure 1B:
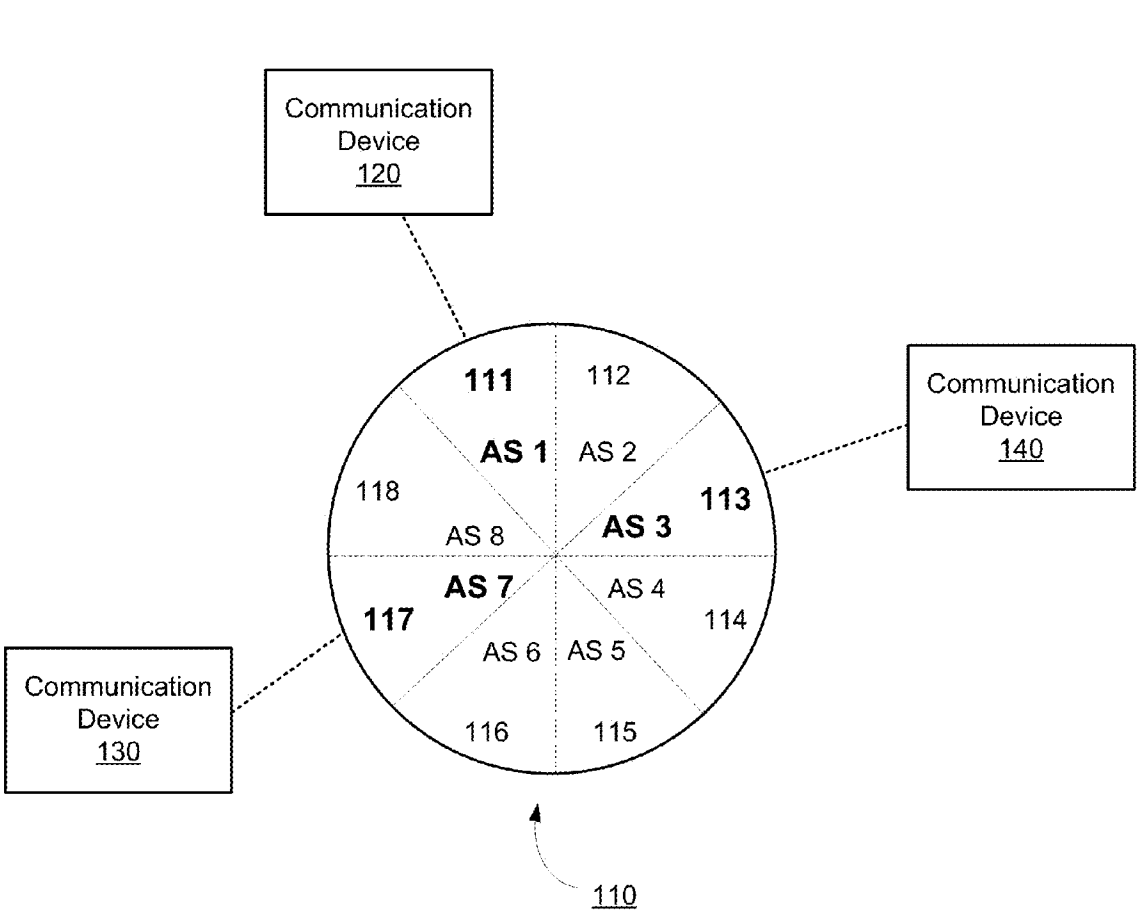
Figure 1C:
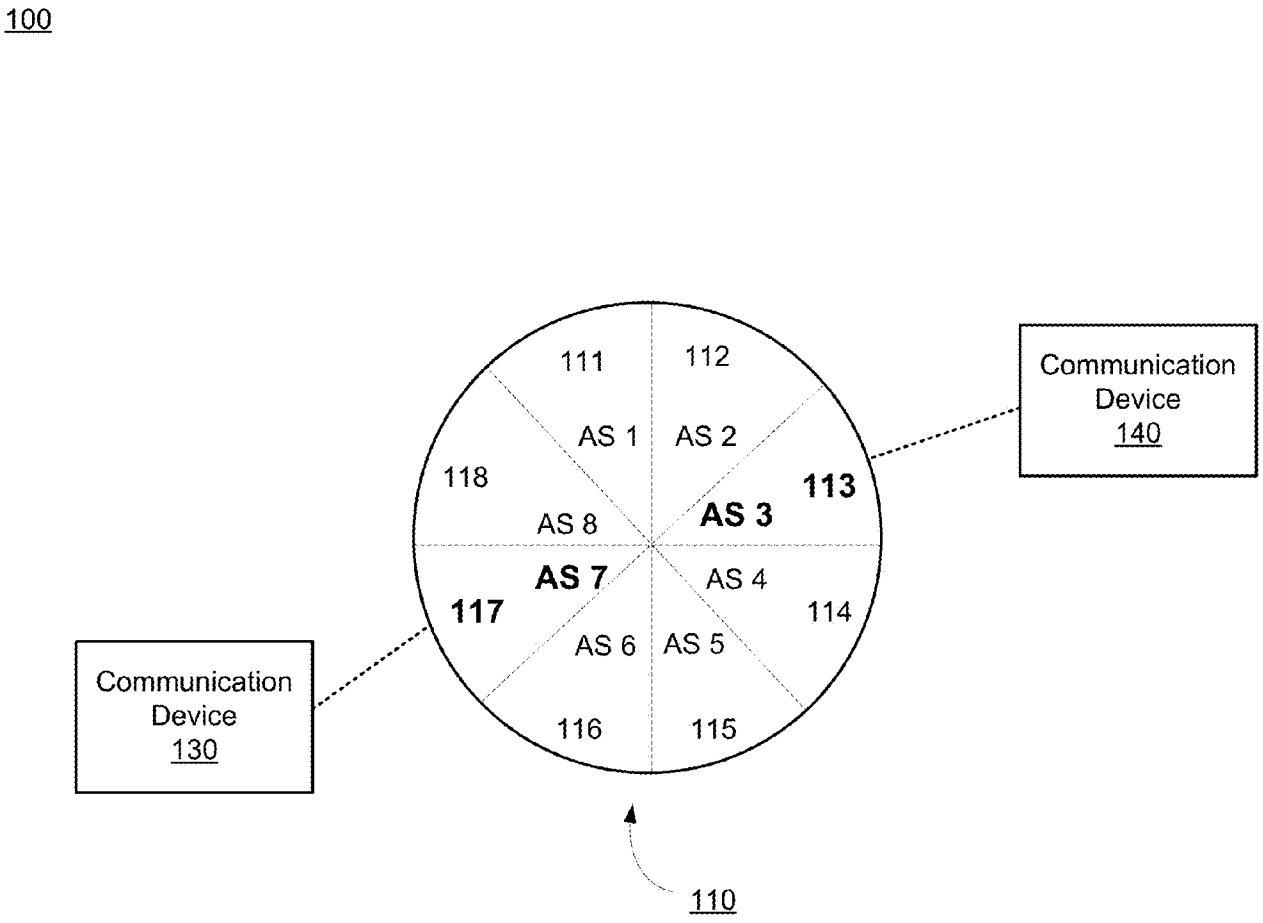

FIGS. 1A-C are schematic illustrations of an example of a multi-segmented antenna system with multiple antenna segments in the activate mode connected to multiple users implemented in a wireless local area network (WLAN) 100, according to different configurations. FIG. 1A illustrates a first configuration of the WLAN 100 where an antenna system 110 includes eight antenna segments (AS1-AS 8) 111-118 disposed around the antenna system 110 such that the antenna segments (AS1-AS 8) 111-118 can transmit and/or receive signals from all directions around the antenna system 110 (e.g., omni-directional coverage across a spherical geographic region of radius equivalent to the range of the antenna system 110), and where two antenna segments (AS1 and AS7) 111 and 117 (shown in bold) are in the activate mode and in communication with communication devices 120 and 130 associated with two users at a first time. The use of eight antenna segments (AS1-AS 8) 111-118 is as an example of one configuration of the antenna system 110. In other configurations, the antenna system 110 can include any number including and above three antenna segments.

In some instances, the communication devices 120 and/or 130 can be, for example, a personal computing device such as a desktop computer with wireless connection capability, a laptop computer with wireless connection capability, a personal digital personal digital assistant (PDA), a standard mobile telephone, a tablet personal computer (PC), and/or the like. In other instances, the communication devices 120 and/or 130 can also be any device that connects a wireless device to a wired network using Wireless Fidelity (Wi-Fi), Bluetooth, cellular (such as a third generation mobile telecommunications (3G) or a fourth generation mobile telecommunications (4G)), or any other wireless communication standard. For example, communication devices 120 and/or 130 can be a wireless access point (AP) or a wireless termination point (WTP).

In FIG. 1A, the antenna segments in the activate mode (AS1 and AS7) 111 and 117 are non-adjacent antenna segments. In other words, the antenna segments in the activate mode are separated by at least one intervening antenna segment not in the activate mode (e.g., antenna segment 118 in FIG. 1A). Selectively enabling or activating the two antenna segments (AS1 and AS7) 111 and 117 as seen in FIG. 1 can include, for example, selectively applying a current to the ground planes of the antenna segments (AS1 and AS7) 111 and 117 by a ground plane control module (not shown in FIG. 1A) at a first time such that communication signals such as transmit signals and receive signals can pass through the antenna segments (AS1 and AS7) 111 and 117 as described in further detail herein. This process can allow the antenna segments (AS1 and AS7) 111 and 117 to establish communication links with communication devices 120 and 130 (associated with two users) at a first time. Alternate ways of activating the different antenna segments (AS1-AS8) 111-118 can also be implemented as described in further detail herein.

FIG. 1B illustrates a second configuration of the WLAN 100 after a second time that includes the antenna system 110 with three antenna segments (AS1, AS 3 and AS7) 111, 113 and 117 in the activate mode and in communication with users associated with the three communication devices 120, 130 and 140. The second time is after the first time. At the first time, the first and second antenna segments (AS1 and AS 7) 111 and 117 are in an activate mode, and the third antenna segment (AS 7) 117 is initially in the deactivate mode (as seen in FIG. 1A). A third user associated with the communication device 140 attempts to communicate (or start a communication link) to the third antenna segment (AS 3) 113 at the second time. In response, the ground plane control module (not shown in FIG. 1B) can selectively activate the ground plane of the third antenna segment (AS 3) 113 such that the ground plane of the third antenna segment (AS 3) 113 is in an activate mode after the second time. This enables transmit signals and receive signals to be exchanged between the third antenna segment (AS 3) 113 and the communication device 140 associated with the third user (or any other communication devices associated with the set of users) after the second time.

FIG. 1C illustrates a third configuration of the WLAN 100 after a third time that includes the antenna system 110 with two antenna segments (AS3 and AS7) 113 and 117 in the activate mode and in communication with two users associated with communication devices 130 and 140. The third time is after the first time and the second time. As described above in connection with FIG. 1B, after the second time, the first, second, and third antenna segments (AS1, AS3 and AS 7) 111, 113 and 117 are in an activate mode. At a third time, the user associated with the communication device 120 that is in communication with the first activate antenna segment (AS 1) 111 terminates the communication (or communication link). In response, in the third configuration after the third time, the ground plane control module (not shown in FIG. 1C) selectively deactivates the ground plane of the first antenna segment (AS 1) 111 such that the ground plane of the first antenna segment (AS 1) 111 is in the deactivate mode after the third time. This terminates the exchange of transmit signals and receive signals between the first antenna segment (AS 1) 111 and the communication device 120 associated with the first user (or any other communication devices associated with the set of users). Additionally, the ground plane control module can selectively divert power away from the antenna segments in the deactivate mode to the antenna segment(s) currently in the activate mode, such that the signals (both receive and transmit signals) passing through the antenna segments in the deactivate mode are attenuated or blocked, and the signals (both receive and transmit signals) passing through the antenna segments in the activate mode are strengthened or enhanced. The implementation of the multi-segmented antenna 110 in the WLAN 100 as described in FIGS. 1A-C can also disable a different antenna segment(s) from the set of antenna segments (AS1-AS8) 111-118 based on no communication devices associated with any users from the set of users being in communication with that different antenna segment(s). Alternate methods of de-activating the different antenna segments (AS1-AS8) 111-118 can also be implemented as described in further detail herein.

The use of the multi-segmented antenna system 110 to transmit and/or receive signals from communication devices associated with a set of users spread across a large geographical area can increase or maximize the gain in signal strength (for both transmit and receive signals) to each group of users connected to the antenna system 110 concurrently. A tradeoff, however, is involved where the maximum gain in signal strength to a given user (that is associated with a given communication device) will be reduced or lowered compared to single lobe steering. But, the overall gain to all the users connected to the antenna system 110 during a time period will be increased relative to the unsteered or omni-directional antenna system. Additionally, the gain in signal strength is applicable for both transmit and receive signals, which can increase overall antenna system 110 throughput and efficiency. This can also lead to an increase in the maximum range of communication between the antenna system 110 and a communication device associated with a user.

Figure 2:
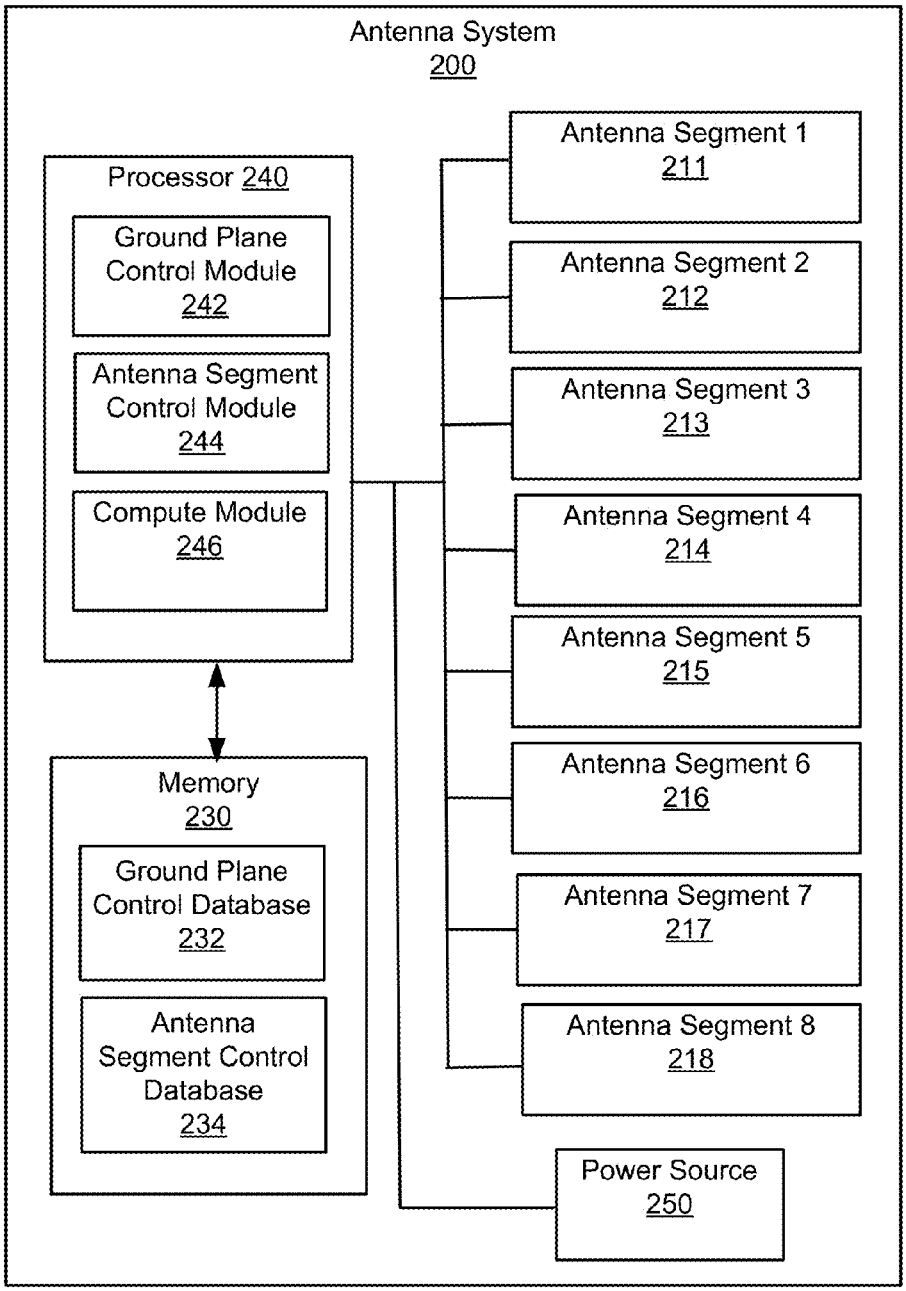
FIG. 2 is a system block diagram of an antenna system, according to an embodiment.

FIG. 2 is a system block diagram of an antenna system 200, according to an embodiment. In some instances, the antenna system 200 can be, for example, a cellular base station antenna system, a Wi-Fi base station antenna system, a parabolic antenna system, a turnstile type transmitting antenna system for Very High Frequency (VHF) low band television broadcasting, a mast radiator antenna system for Amplitude Modulation (AM) radio broadcasting, and/or the like. In other instances, the antenna system 200 can also be, for example, an antenna system integrated within a desktop computer (that has wireless connection capability), a laptop computer, a personal digital personal digital assistant (PDA), a standard mobile telephone, a tablet personal computer (PC), and/or the like. The signals sent and/or received via the antenna system 200 can include or represent, for example, voice data, textual data, video data, audio data, multimedia data, and/or combinations of the same. Similar to the antenna system 110 implemented in the WLAN in FIG. 1, antenna system 200 also includes eight antenna segments 211-218. Additionally, the antenna system 200 includes a processor 240 that is operatively coupled to a memory 230, and a power source 250.

The antenna segments 211-218 in FIG. 2 are similar to the antenna segments 111-118 implemented in the WLAN 100 in FIG. 1. Each antenna segment 211-218 is configured to communicate with a set of users within a pre-defined geographical region (or volume). For example, in one configuration where the eight antenna segments 211-218 are disposed in a circular configuration about the antenna system 200, each individual antenna segment can be configured to establish, maintain, and/or terminate communication links with one or more communication devices associated with a variety of users in a region (or volume) equivalent to one-eighth slice of a sphere. Other configurations of the antenna segments 211-218 can allow each antenna segment 211-218 to communicate with users in different geographical pattern and region (or volume). In some embodiments, the antenna segments 211-218 can each include a separate ground plane for controlling the activation and/or deactivation of the antenna segments 211-218. In other embodiments, a single common ground plane can selectively activate and/or deactivate the antenna segments (not shown in FIG. 2). In such embodiments, a switching mechanism can connect each individual antenna segment to the common ground plane to activate the antenna segments. In such embodiments, the switching mechanism can also disconnect the individual antenna segments from the common ground plane to deactivate the antenna segments. In yet other embodiments, the antenna segments do not include ground planes and are activated and/or deactivated by other mechanisms as described in detail in FIG. 3 below.

In the transmission mode, an antenna segment 211-218 can receive an oscillating radio frequency (RF) electrical signal that may have been generated at, for example, the processor 240. The antenna segments 211-218 can include antenna conductors that can convert the electrical energy from the signal into electromagnetic wave energy and radiate the electromagnetic wave (i.e., radio wave) energy. In the reception mode, the antenna conductors can intercept some of the energy of an incoming electromagnetic wave (i.e., a radio wave) and can convert the electromagnetic wave energy into electrical energy that can produce an electrical voltage or current that can be transmitted as an electrical signal to the rest of components of the antenna system 200. In some instances, the incoming electrical signal can also undergo additional amplification steps within the antenna segments 211-218 before being sent to the rest of components of the antenna system 200.

The memory 230 can be a computer storage product such as, for example, a random access memory (RAM), a memory buffer, a hard drive, a database, an erasable programmable read-only memory (EPROM), an electrically erasable read-only memory (EEPROM), and/or so forth. The memory 230 is operatively coupled to the processor 240 and can store instructions to cause the processor 240 to execute modules, processes and/or functions associated with individual antenna segments 211-218 and/or the other components of the antenna system 200. The memory 230 can include a ground plane control database 232 and an antenna segment control database 234.

The ground plane control database 232 can contain entries associated with the current state of each of the antenna segments 211-218 (e.g., activate state within activate mode or deactivate mode, or deactivate state within activate mode or deactivate mode), the current number of communication devices associated with users that are in communication with the different antenna segments 211-218, the media access control (MAC) address of each of the different communication devices associated with the users, the current signal strength of the transmit and/or receive signals passing through each antenna segment 211-218, instructions on selectively attenuating signals from antenna segments 211-218 in the deactivate mode, instructions on selectively strengthening signals from antenna segments 211-218 in the activate mode, instructions on diverting power away from newly deactivated antenna segments 211-218 to currently activated antenna segments 211-218, and/or the like. Such entries can be accessed and implemented by the ground plane control module 242 that can selectively activate or deactivate the ground planes of the different antenna segments 211-218 according to the different working conditions (e.g., new users establishing communication links with the antenna segments 211-218, existing users terminating communication with the antenna segments 211-218, etc.).

The antenna segment control database 234 can contain entries associated with control and maintenance of different antenna segments 211-218 that can be implemented with mechanisms other than affecting a change in the ground plane of the antenna segments 211-218. The entries of the antenna segment control database 234 can include, for example, instructions on opening and/or closing an electric circuit between an antenna segment 211-218 and a power source 250, the current number of communication devices associated with users that are in communication with the different antenna segments 211-218, the media access control (MAC) address of each of the different communication devices associated with the users, the current signal strength of the send and/or receive signals passing through each antenna segment 211-218, and/or the like. Such entries can be accessed by the antenna segment control module 244 (in the processor 240) to selectively activate or deactivate different antenna segments

211-218 according to the different conditions (e.g., new users establishing communication with antenna segments, existing users terminating communication with antenna segments, etc.). The mechanisms for activating and deactivating different antenna segments 211-218 that are implemented by the antenna segment control module 244 based on instructions and/or information located in the entries of the control database 234 do not involve affecting any changes to the ground plane of the antenna segments. These alternative mechanisms of controlling antenna segments 211-218 can be useful in instances when: (1) a failure with the ground planes of the antenna segments 211-218 occurs; (2) a failure of the ground plane control module 242 occurs and/or corruption of data entries in the ground plane control database 232 occurs, and/or; (3) the antenna segments 211-218 used in the antenna system 200 do not have any ground planes.

The processor 240 can be, for example, a general purpose processor, a Field Programmable Gate Array (FPGA), an Application Specific Integrated Circuit (ASIC), a Digital Signal Processor (DSP), and/or the like. The processor 240 can be configured to run and/or execute processes, and/or other modules, and/or functions associated with the individual antenna segments 211-218 and/or the other components of the antenna system 200. The processor 240 can include a ground plane control module 222, an antenna segment control module 244, and a compute module 246.

The ground plane control module 242 can access the entries of the ground plane control database 232 and any other entries in the rest of the memory 230, and can implement the instructions or use information contained within the entries. Such instructions and information can allow the ground plane control module 242 to selectively activate or deactivate the ground planes of the different antenna segments 211-218 according to the different conditions as described above. For example, the ground plane control module 242 can selectively attenuate signals from antenna segments 211-218 in the deactivate mode, selectively strengthen signals from antenna segments 211-218 in the activate mode, divert power away from newly deactivated antenna segments 211-218 to currently activated antenna segments 211-218, and/or the like. In some instances, periodically (e.g., every 100 msec, 10 msec, 1 msec, or 1 sec, etc.), the processor 240 can allow the antenna system 200 to enter into the beaconing mode, where the antenna system 200 switches from a directional mode of operation to an omni-directional mode of operation to search for communication devices associated with new users in the geographical region associated with the different antenna segments 211-218. In such instances, all antenna segments 211-218 are selected to enter the activate mode and search for (beaconing) RF signals transmitted by communication devices that are indicative of new users. The (beaconing) signals indicative of new users can be received by the antenna conductors within the different antenna segments 211-218. The contents of the (beaconing) signals can be analyzed in the processor 240 to search for the MAC address of the communication device and/or a user identifier that cannot be matched with the entries in the memory 230 (that includes the ground plane control database 232 and the antenna segment control database 234) to determine if communication with a communication device associated with a new user is established or attempting to be established. If communication with a new user has been established or is attempting to be established via an antenna segment 211-218 that was already in the activate mode (before the antenna system entered the beaconing mode), then the ground plane control module 242 or the antenna segment control module 244 can be configured to allow the antenna segment 211-218 to remain in the activate mode after the antenna system 200 switches back to the directional mode of operation (from the beaconing mode, i.e., omni-directional mode of operation). If communication with a new user has been established in an antenna segment 211-218 that was in the deactivate mode, then the ground plane control module 242 can be configured to selectively activate that antenna segment 211-218 after the antenna system 200 switches back to the directional mode (from the beaconing mode, e.g., omni-directional mode of operation).

The antenna segment control module 244 can access the entries of the antenna segment control database 234 and any entries in the rest of the memory 230, and can implement the instructions and/or use the information contained within the entries. Such instructions and information can allow the antenna segment control module 244 to selectively activate and/or deactivate the different antenna segments 211-218, and affect any other alterations or changes to the antenna system 200 configuration according to different conditions (as described above) by using mechanisms that do not involve affecting a change in the ground plane of the antenna segments 211-218. For example, as described above, the antenna segment control module 244 can activate or deactivate the different antenna segments 211-218 by sending a signal that can open and/or close an electric circuit (not shown in FIG. 2) between an antenna segment 211-218 and the power source 250.

The compute module 246 can be a hardware module and/or a software module stored in the memory 230 and/or executed in a processor 240 of the antenna system 200. The compute module 246 can implement various post-reception treatment methods for signals associated with the different antenna segments 211-218 such as, for example, filtering, amplification, sampling and reconstruction, aliasing, amplitude modulation, frequency modulation, digitization, and/or the like. The compute module 246 can generate transmit signals for the different antenna segments 211-218 and can implement various treatment methods on the transmit signals such as, for example, signal amplification, digitization, filtering, aliasing, amplitude modulation, frequency modulation, and/or the like. These transmit signals can be sent from the compute module 246 to the appropriate antenna segment(s) 211-218.

The power source 250 can be a stand alone power supply device or a built-in power supply device inside the antenna system 200 that can be used by the ground plane control module 242 and/or the antenna segment control module 244 to activate the different antenna segments 211-218. The power source 250 can be, for example, a direct current (DC) voltage or current source, an alternate current (AC) voltage or current source, and/or the like. The power source 250 can also be used to power the different components of the antenna system such as, for example, the antenna segments 211-218, the processor 240 and the memory 230, and/or the like.

Figure 3A:
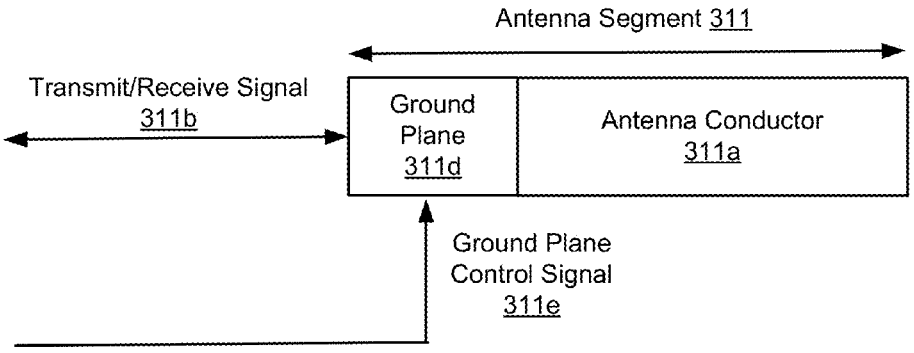
FIGS. 3A-B are system block diagrams showing an antenna segment that includes a ground plane and signals to activate and/or de-activate the antenna segment, according to an embodiment.
Figure 3B:
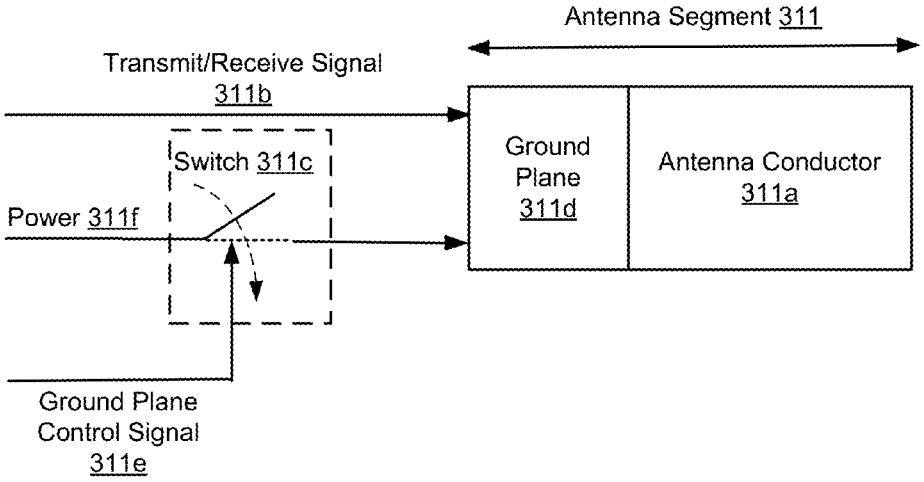

FIGS. 3A-B are system block diagrams showing an antenna segment that includes a ground plane and signals to activate and/or de-activate the antenna segment, according to an embodiment. FIGS. 3A-B shows an antenna segment 311 and signals to activate and/or deactivate the antenna segment 311 that includes a ground plane 311*d* and an antenna conductor 311*a*. The antenna conductor 311*a* can include an arrangement of metallic conductors of various shapes and sizes that can act as RF transmitters and/or receivers. During operation of the antenna segment 311 when in the activated mode (during transmission), a current of electrons sent through the antenna segment 311 by, for example, a ground plane control module can produce an oscillating magnetic field around the antenna conductor 311*a*, while the charge of the electrons can also produce an oscillating electric field along the metallic conductors of the antenna conductor 311*a*. These time-varying fields can radiate away from the antenna segment 311 into space as an electromagnetic field wave (e.g., radio waves). Conversely, during reception, the oscillating electric and magnetic fields of an incoming radio wave can exert a force on the electrons in the metallic conductors of the antenna conductor 311*a*, causing the electrons to move back and forth, and thus creating oscillating currents in the antenna segment 311.

The ground plane 311*d* of the antenna segment 311 can include a nonconductive material such as, for example, a plastic(s) or glass that is impregnated with a conductive material such as metallic particles. The ground plane 311*d* is configured to be substantially radio-frequency transparent in the absence of a current (or signal), and substantially radio-frequency reflective in the presence of a current (or signal). In some instances, such as in FIG. 3A, the antenna segment 311 can be activated by the ground plane control module (e.g., ground plane control module 242 in FIG. 2) sending a ground plane control signal 311*e* (or a current) directly to the ground plane 311*d* of the antenna segment 311 (making the ground plane 311*d* reflective to RF waves) such that communication signals (e.g., transmit/receive signals 311*b*) can flow through the antenna segment 311. In other instances, such as in FIG. 3B, the antenna segment 311 can be activated by the ground plane control module (e.g., ground plane control module 242 in FIG. 2) sending a ground plane control signal 311*e* (or a current) that closes a circuit (e.g., via the switch 311*c*) between the ground plane 311*d* and a power source (e.g., power source 250 in FIG. 2). This can allow power 311*f* (or a current) to pass from the power source to the ground plane 311*d* that makes the ground plane 311*d* reflective to RF waves and allows communication signals (e.g., transmit/receive signals 311*b*) to flow through the antenna segment 311. Deactivation of the antenna segment 311 can involve the ground plane control module terminating the ground plane control signal 311*e* that result in the ground plane 311*d* being transparent to RF waves, and cease the flow of communication signals (e.g., transmit/receive signals 311*b*) through the antenna segment 311.

The embodiments shown in FIGS. 3A-B allude to each antenna segment 311 being associated with a dedicated ground plane 311*d* to control the activation and/or deactivation of the antenna segment 311. In other embodiments, however, a single common ground plane can selectively activate and/or deactivate multiple antenna segments in an antenna system (such as antenna segments 211-218 in FIG. 2 or antenna segments 111-118 in FIG. 1). In such embodiments, a switching mechanism can connect each individual antenna segment to the common ground plane to activate the antenna segments. In such embodiments, the switching mechanism can also disconnect the individual antenna segments from the common ground plane to deactivate the antenna segments.

Figure 4:
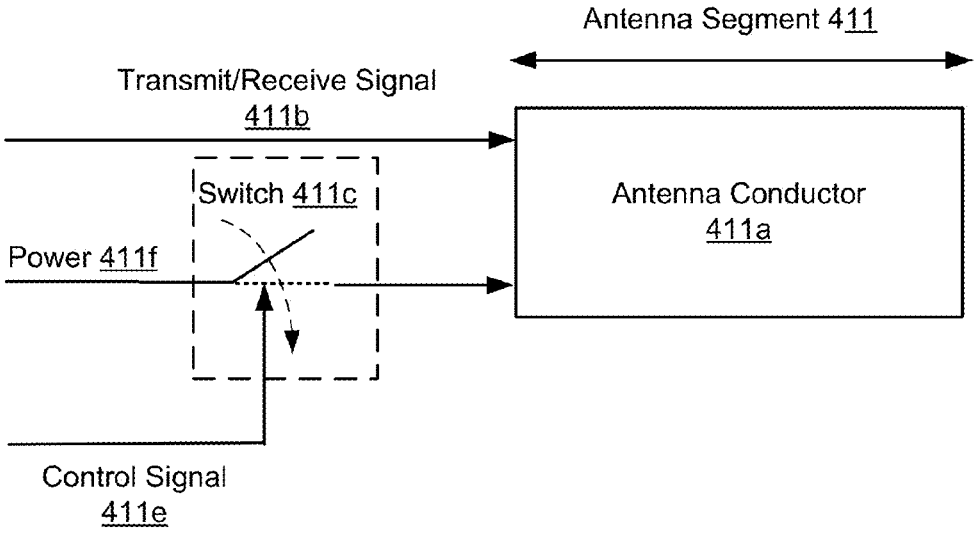
FIG. 4 shows an antenna segment without a ground plane and signals to activate and/or deactivate the antenna segment, according to an embodiment.

FIG. 4 shows an antenna segment without a ground plane and signals to activate and/or deactivate the antenna segment, according to an embodiment. In such embodiments, the antenna segment 411 can be activated without involving controlling a ground plane (e.g., ground plane 311*d* in FIG. 3) and can include the processor of the antenna system (e.g., processor 240 in FIG. 2) sending a control signal 411*e* (or a current) that closes a circuit (e.g., via the switch 411*c*) between the antenna segment 411 and a power source (e.g., power source 250 in FIG. 2). This can allow power 411*f* (or a current) to pass from the power source to the antenna segment 411 and can allow communication signals (e.g., transmit/receive signals 311*b*) to flow through the antenna segment 411. Deactivation of the antenna segment 411 can involve the processor of the antenna system terminating the control signal 411*e* that can open the circuit (e.g., via the switch 411*c*) between the antenna segment 411 and the power source. This can cease the flow of communication signals (e.g., transmit/receive signals 411*b*) through the antenna segment 411 because the antenna segment 411 does not operate due to lack of power 411*f* from the power source.

Figure 5A:
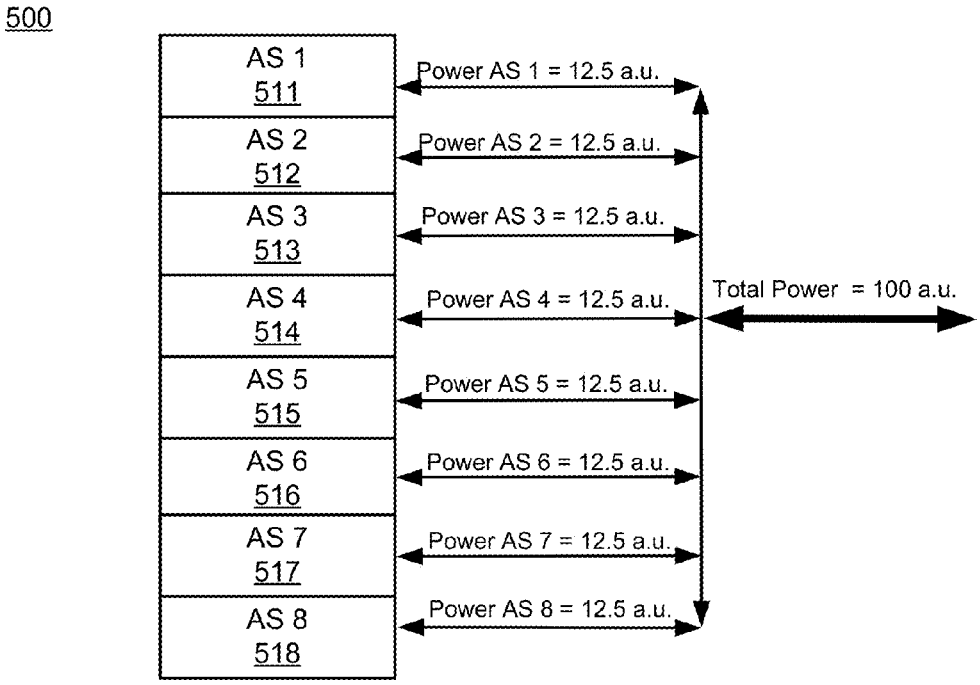
FIGS. 5A-C are logical block diagrams showing the power distribution among the eight antenna segments in the antenna system at different configurations.
Figure 5B:
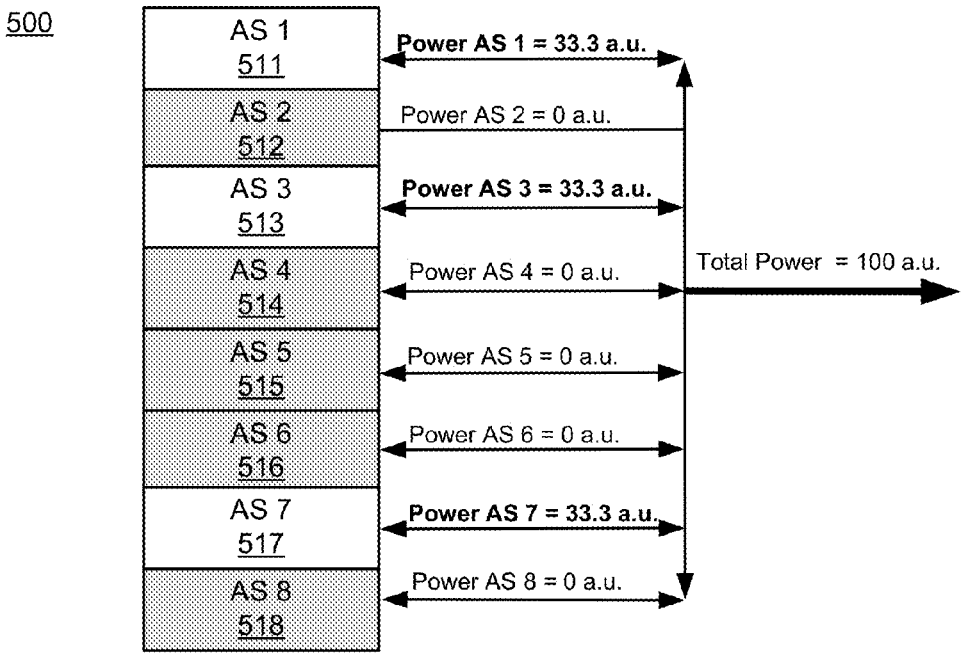
Figure 5C:
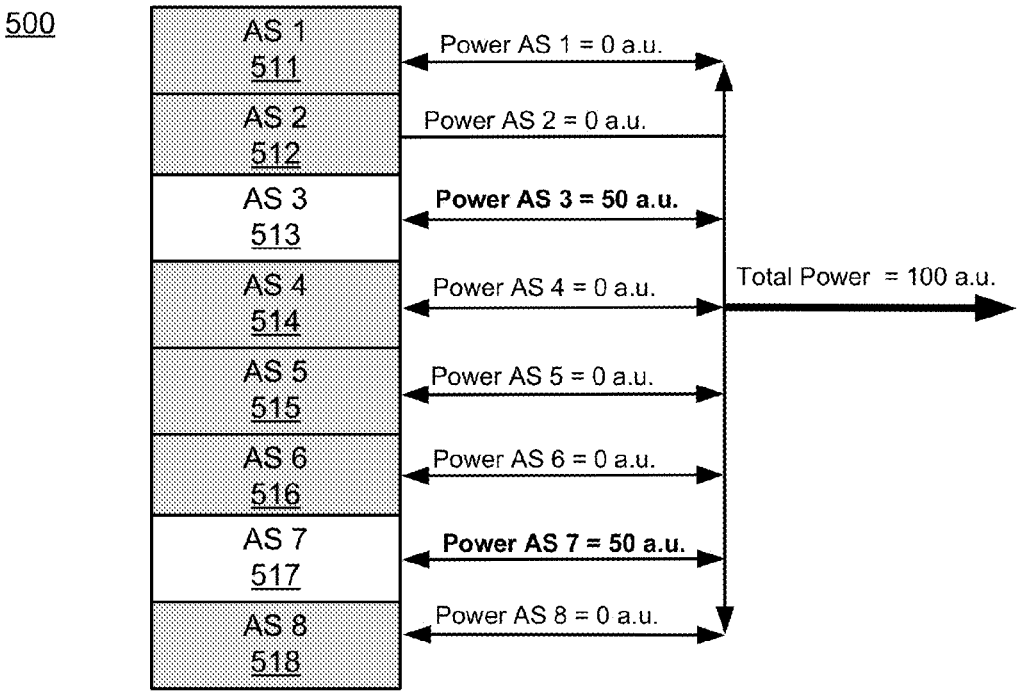

FIGS. 5A-C are logical block diagrams showing the power distribution among the eight antenna segments 511-518 in the antenna system 500 at different configurations. FIG. 5A is a logical block diagram showing power distribution among the eight antenna segments 511-518 of the antenna system 500 in a first configuration when all the antenna segments are in the activate mode. In all the examples of FIGS. 5A-C, the total power used by the antenna system 500 is set to 100 a.u. (where a.u. stands for arbitrary units) as the total power (or amount of energy) in the antenna system 500 is assumed to remain constant (or is conserved) over time. When all the eight antenna segments (AS1-AS8) 511-518 are in the activate mode, each antenna segment 511-518 uses approximately 12.5 a.u. of power.

FIG. 5B shows a second configuration where three antenna segments (AS1, AS3, and AS7) 511, 513, and 517 are in the activate mode, and the rest of the five antenna segments (AS2, AS4, AS5, AS6, AS8) 512, 514, 515, 516, 518 are in the deactivate mode. In the second configuration, the ground plane control module (e.g., ground plane control module 242 in FIG. 2) and/or the antenna segment control module (e.g., antenna segment control module 244 in FIG. 2) of the antenna system 400 can be configured to divert power from the deactivated antenna segments (AS2, AS4, AS5, AS6, AS8) 512, 514, 515, 516, 518 to the antenna segments that are in the activate mode (AS1, AS3, and AS7) 511, 513, and 517. This is done so that any signals to the antenna segments in the deactivated mode are attenuated and all signals to the antenna segments in the activate mode can be strengthened or enhanced. In the second configuration, antenna segments 511, 513, and 517 each use approximately 33.33 a.u. of power and antenna segments 512, 514, 515, 516, and 518 each use approximately 0 a.u. of power.

FIG. 5C shows a third configuration where two antenna segments (AS3, and AS7) 513, and 517 are in the activate mode, and the rest of the six antenna segments (AS1, AS2, AS4, AS5, AS6, AS8) 511, 512, 514, 515, 516, 518 are in the deactivated mode. In this configuration, power is also diverted by the ground plane control module and/or the antenna segment control module from the antenna segments in the deactivate mode to the antenna segments in the activate mode as described above. In the third configuration, antenna segments 513, and 517 each use approximately 50 a.u. of power and antenna segments 511, 512, 514, 515, 516, 518 each use approximately 0 a.u. of power. Hence, signals passing through the antenna segments in the activate mode (AS3 and AS7) 513 and 517 are strengthened when compared to the first configuration (shown in FIG. 5A) when all eight antenna segments are in the activate mode (i.e., 50 a.u. of power >12.5 a.u. of power). Similarly, signals passing through the antenna segments in the deactivated mode (AS1, AS2, AS4, AS5, AS6, AS8) 511, 512, 514, 515, 516, 518 are attenuated when compared to the first configuration (shown in FIG. 4A) when all eight antenna segments are in the activate mode (i.e., 0 a.u. of power <12.5 a.u. of power).

Figure 6:
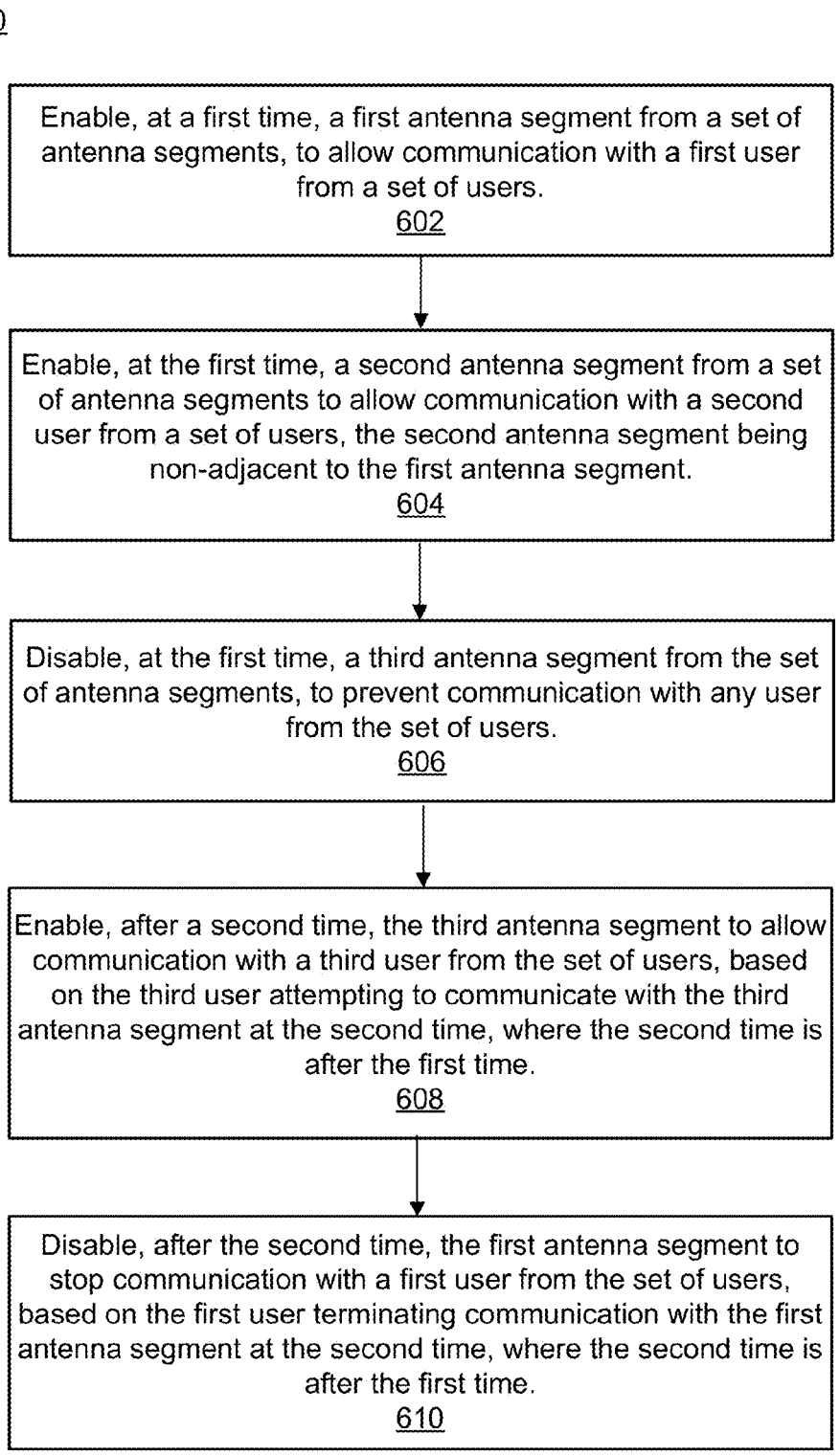
FIG. 6 is a flow chart illustrating a method of activating and de-activating various antenna segments in an antenna system according to the communication environment within which the antenna system is disposed, according to an embodiment.

FIG. 6 is a flow chart illustrating a method 600 of activating and de-activating various antenna segments in an antenna system according to the communication environment within which the antenna system is disposed, according to an embodiment. At 602, at a first time, a first antenna segment from a set of antenna segments is enabled (or activated) to allow communication with a first user from a set of users. As described above, in instances where the antenna segments include a ground plane, the first antenna segment can be enabled (or activated) by, for example, the ground plane control module that sends a signal (or a current) to the ground plane that makes the ground plane reflective to RF waves. As described above, in instances where the antenna segments do not include a ground plane, the first antenna segment can be enabled (or activated) by, for example, the antenna segment control module (in the processor) that can send a control signal (or current) to close a circuit between the antenna segment and a power source, thus allowing power (or current) to flow from the power source to the first antenna segment.

At 604, a second antenna segment from the set of antenna segments is enabled (or activated) at the first time that allows communication with a second user from the set of users. The second antenna segment is non-adjacent to the first antenna segment in one possible configuration of the antenna system. As described above, the second antenna segment can be enabled (or activated) by the ground plane control module or the antenna segment control module in a manner similar to enabling the first antenna segment.

At 606, a third antenna segment from the set of antenna segments is disabled (or deactivated) at the first time and prevents communication with any user from the set of users. As described above, in instances where the antenna segments include a ground plane, the third antenna segment can be disabled (or de-activated) by, for example, by the ground plane control module that can block sending a signal (or a current) to the ground plane. This can make the ground plane transparent to RF waves. As described above, in instances where the antenna segments do not include a ground plane, the third antenna segment can be disabled (or de-activated) by, for example, the antenna segment control module that can send a control signal (or current) to open a circuit between the antenna segment and a power source, thus blocking power (or current) to flow to the third antenna segment.

At 608, the third antenna segment is enabled (or activated) after a second time after the first time. The third antenna segment is enabled (or activated) after the second time to allow communication with a third user from the set of users based on the third user attempting to communicate with the third antenna segment at the second time. As described above, the third antenna segment is enabled in a manner similar to enabling the first antenna segment and the second antenna segment. As described above, the third user can be detected by the antenna system during the beaconing mode where the antenna system switches from the directional mode of operation to the omni-directional mode of operation to search for new users. In the beaconing mode, the antenna system can receive a (beaconing) signal from a communication device indicative of the third user (that is a new user) from the set of users where the third user is attempting to communicate (i.e., establish a new communication link) with the third antenna segment.

At 610, the first antenna segment is disabled (or deactivated) after the second time. The first antenna segment is disabled (or de-activated) after the second time to stop communication with the first user from the set of users based on the first user terminating communication with the first antenna segment at the second time. As described above, the first antenna segment can be disabled by, for example, either the ground plane control module or the antenna segment control module in manner similar to disabling the third antenna segment as described above. Upon disabling the first antenna segment, the ground plane control module or the antenna segment control module can selectively divert power from the newly-disabled first antenna segment to the other antenna segments that are in the activate mode (enabled). Diverting power away from the first antenna segment can allow the signals to the first antenna segment to be attenuated, and thus the first antenna segment is no longer able to send and/or receive signals from the set of users. Diverting power to the antenna segments that are in the activate mode (enabled) such as, for example, the second and third antenna segments, strengthens the reception and transmission of the enabled (activate) antenna segments. This can allow the signals passing through the enabled antenna segments to be strengthened or enhanced.

Implementing an antenna system with multiple antenna segments as described above, and periodically switching the antenna system from the directional mode of operation to the omni-directional mode of operation (during the beaconing mode) to search for new users can lead to a gain in signal strength (for both transmit and receive signals) for all users connected to the antenna system at the expense of gain reduced in directions with no users. This can lead to significant increase in the throughput of the antenna system (i.e. the rate of sending and receiving signals from multiple users concurrently) and/or the maximum range of a user (associated with a communication device) that can communicate with the antenna system. The increased throughput and/or maximum range of the antenna system can lead to fewer antenna systems used for communicating with a group of users in a specific geographical region.

Some embodiments described herein relate to a computer storage product with a non-transitory computer-readable medium (also can be referred to as a non-transitory processor-readable medium) having instructions or computer code thereon for performing various computer-implemented operations. The computer-readable medium (or processor-readable medium) is non-transitory in the sense that it does not include transitory propagating signals per se (e.g., a propagating electromagnetic wave carrying information on a transmission medium such as space or a cable). The media and computer code (also can be referred to as code) may be those designed and constructed for the specific purpose or purposes. Examples of non-transitory computer-readable media include, but are not limited to: magnetic storage media such as hard disks, floppy disks, and magnetic tape; optical storage media such as Compact Disc/Digital Video Discs (CD/DVDs), Compact Disc-Read Only Memories (CD-ROMs), and holographic devices; magneto-optical storage media such as optical disks; carrier wave signal processing modules; and hardware devices that are specially configured to store and execute program code, such as Application-Specific Integrated Circuits (ASICs), Programmable Logic Devices (PLDs), Read-Only Memory (ROM) and Random-Access Memory (RAM) devices.

Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using imperative programming languages (e.g., C, Fortran, etc.), functional programming languages (Haskell, Erlang, etc.), logical programming languages (e.g., Prolog), object-oriented programming languages (e.g., Java, C++, etc.) or other suitable programming languages and/or development tools. Additional examples of computer code include, but are not limited to, control signals, encrypted code, and compressed code.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above.

What is claimed is:

1. An apparatus, comprising:

an antenna segment control module configured to (1) selectively attenuate signals to a plurality of antenna segments, and (2) selectively strengthen signals to the plurality of antenna segments, the plurality of antenna segments including (1) a first antenna segment in communication with a first user from a plurality of users, (2) a second antenna segment in communication with a second user from the plurality of users, and (3) a third antenna segment not in communication with the plurality of users;

the antenna segment control module configured to divert power from the third antenna segment to the first antenna segment and to the second antenna segment such that (1) a signal to the third antenna segment is attenuated and the third antenna segment is unable to send and receive signals from the plurality of users, (2) a signal to the first antenna segment is strengthened, and (3) a signal to the second antenna segment is strengthened.

2. The apparatus of claim 1, wherein the antenna segment control module is configured to (1) receive a signal indicative of a third user from the plurality of users attempting to communicate with the third antenna segment, and (2) divert power, based on the signal indicative of the third user, to the third antenna element from the first antenna segment and from the second antenna segment.

3. The apparatus of claim 1, the antenna segment control module configured to restrict a current to a ground plane of the third antenna segment such that the signal to the third antenna segment is attenuated.

4. The apparatus of claim 1, the antenna segment control module configured to open a circuit between the third antenna segment and a power source such that the signal to the third antenna segment is attenuated.

5. The apparatus of claim 1, wherein the antenna segment control module is configured to increase gain to the first user when the antenna segment control module strengthens the signal to the first antenna segment.

6. The apparatus of claim 1, wherein each antenna segment from the plurality of antenna segments includes a ground plane that is (1) substantially radio frequency transparent in the absence of a current, and (2) substantially radio frequency reflective in the presence of a current.

7. The apparatus of claim 1, wherein the signal to the third antenna segment is a first signal to the third antenna segment, and wherein:

the antenna segment control module is configured to divert power from the third antenna segment to the first antenna segment and to the second antenna segment at a first time, the antenna segment control module is configured to divert power from the first antenna segment and from the second antenna segment to the third antenna segment after the first time such that a second signal sent to the third antenna segment is strengthened and the third antenna segment is able to send and receive signals to a third user from the plurality of users.

8. The apparatus of claim 1, wherein the plurality of antenna segments are coupled to a ground plane that is (1) substantially radio frequency transparent in the absence of a current, and (2) substantially radio frequency reflective in the presence of a current.

* * * * *